US005856956A

United States Patent [19]

Toki

[11] Patent Number: 5,856,956

[45] **Date of Patent: *Jan. 5, 1999**

[54] PIEZOELECTRIC ACOUSTIC TRANSDUCER

[75] Inventor: Nozomi Toki, Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 846,031

[22] Filed: Apr. 25, 1997

[30] Foreign Application Priority Data

May 2, 1996 [JP] Japan ..... 8-111562

[51] Int. Cl.[6] ..... H04R 17/00

[52] U.S. Cl. ..... 367/160; 367/161; 367/163; 367/174; 310/324; 310/332

[58] Field of Search ..... 367/160, 161, 367/163, 174, 157; 310/324, 332

[56] References Cited

U.S. PATENT DOCUMENTS 5,382,864 1/1995 Morikawa et al. ..... 310/332

5,619,997 4/1997 Kaplan ..... 128/660.02

FOREIGN PATENT DOCUMENTS

| | | |
|---|---|---|
| 711096 | 5/1996 | European Pat. Off. . |
| 57-166717 | 10/1982 | Japan . |
| 60-182300 | 9/1985 | Japan . |
| 63-227199 | 9/1988 | Japan . |
| 63-227200 | 9/1988 | Japan . |
| 60-68798 | 5/1997 | Japan . |
| 318934 | 12/1930 | United Kingdom . |
| 603354 | 6/1948 | United Kingdom . |
| 656819 | 9/1951 | United Kingdom . |
| 926435 | 5/1963 | United Kingdom . |
| 1083477 | 9/1967 | United Kingdom . |

*Primary Examiner*—J. Woodrow Eldred
*Attorney, Agent, or Firm*—Scully, Scott, Murphy & Presser

[57] ABSTRACT

The piezoelectric-acoustic transducer of the present invention has a hollow case provided with a sound hole. A piezoelectric actuator is disposed inside this case that has one end fixed to the case and that bends in the direction of the thickness of the case when voltage is applied. A diaphragm is secured to one portion of the piezoelectric actuator and is positioned at a distance from the piezoelectric acturator in the direction of the thickness of the case.

6 Claims, 10 Drawing Sheets

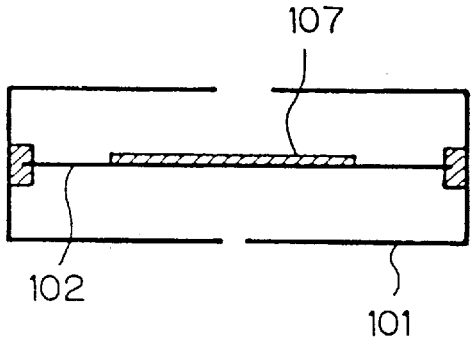
Fig. 1 (a) Prior Art
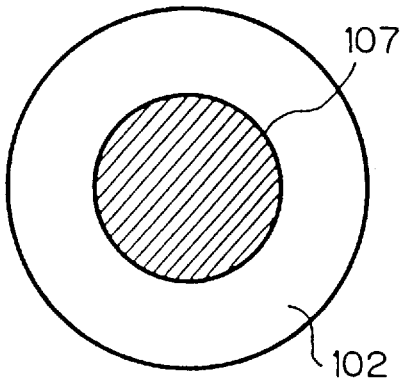
Fig. 1 (b) Prior Art

PIEZOELECTRIC ACOUSTIC TRANSDUCER

BACKGROUND OF THE INVENTION

1. Field of the Invention

The present invention relates to a piezoelectric-acoustic transducer, and particularly to a piezoelectric-acoustic transducer used with the object of reducing both costs and power consumption, such as in piezoelectric receivers, piezoelectric speakers, and piezoelectric sounders.

2. Description of the Related Art

Piezoelectric-acoustic transducers are widely used as devices for converting electrical signals to acoustic signals because they enable low power consumption and compact size.

FIG. 1(*a*) is a sectional view of a piezoelectric-acoustic transducer of the prior art, and FIG. 1(*b*) is a plan view of the interior of this device. In FIGS. 1(*a*) and 1(*b*), diaphragm 102 is supported and secured around the entire circumference of its outer edge inside the unit case 101. Piezoelectric ceramic 107 is attached to the surface of diaphragm 102. By applying voltage to piezoelectric ceramic 107, piezoelectric ceramic 107 bends according to the direction of the applied voltage, bending in an upward direction as shown in FIG. 2(*a*) or bending in a downward direction as shown in FIG. 2(*b*), and sound pressure is in turn generated by the bending of diaphragm 102 that occurs with this bending. Materials that may be employed for this diaphragm 102 are limited by the relation between piezoelectric ceramic 107 and thermal expansion coefficients.

With this type of piezoelectric-acoustic transducer, a high level of distortion of the diaphragm is necessary to generate great sound pressure. To this end, Japanese Patent Laid-open No. 227199/88 and Japanese Patent Laid-open No. 227200/88 disclose piezoelectric-acoustic transducers in which distortion of the diaphragm is facilitated by making the periphery of the diaphragm thinner. Such a diaphragm has a piezoelectric bimorph construction in which the diaphragm is composed of two layers of piezoelectric ceramics and is secured and supported around its circumference. Japanese Patent Laid-open No. 227200/88 in particular discloses a construction in which the boundary area between the secured/supported portion and the free-state portion, or the free-state portion adjacent to this boundary, is thinner than the portion in which the bimorph is formed. In Japanese Patent Laid-open No. 227199/88, at least one recessed portion is formed at the boundary between the secured/supported area and the free-state portion, or in the free-state portion adjacent to this area, and by this construction, the circumference of the diaphragm is made thinner.

Japanese Patent Laid-open No. 166717/82 discloses a bimorph piezoelectric oscillator that is constructed by bonding a metal plate to a piezoelectric plate and that is secured at two opposing locations on the periphery of the vibrator with the remaining portion of the periphery left free, thereby increasing the area that functions as a electroacoustic transducer.

However, all of the above-described prior-art piezoelectric-acoustic transducers generate sound pressure through distortion of a diaphragm formed in a single unit with a monolithic piezoelectric unit, and as a result, all suffer from the following drawbacks: First, the conversion efficiency to sound waves is poor and increasing the generated sound pressure is difficult. Not only is there is a limit to the extent to which the periphery of the diaphragm can be thinned in order to facilitate distortion of the diaphragm, but this modification cannot be expected to greatly increase sound pressure. As a second drawback, generated sound waves exhibit a high level of harmonic distortion, and this distortion becomes dramatically worse at sound pressures above a particular level. This problem occurs first because the operation of the diaphragm exhibits a hysteresis characteristic rather than a linear characteristic with respect to the applied voltage, and this characteristic consequently causes irregularity in the phase of generated sound waves. In addition, distortion in sound waves is also caused because the displacement of the diaphragm is limited, and at distortions of the diaphragm greater than a particular level, the displacement becomes nonlinear with respect to input signals.

Finally, a piezoelectric-acoustic transducer of the prior art also has the drawback that the selection of material, weight, and rigidity of the diaphragm is constrained because the diaphragm is formed as a single unit with the piezoelectric that drives the diaphragm, and these constraints limit the degree of design freedom for obtaining ideal acoustic characteristics.

SUMMARY OF THE INVENTION

In view of these problems, the present invention was developed with the object of providing a piezoelectric-acoustic transducer that generates greater sound pressure while maintaining the characteristics of low power consumption and compact size. A second object of the present invention is to reduce distortion of generated sound waves, and a third object is to increase the degree of freedom in design to obtain the required acoustic characteristics.

To achieve the above-described objects, a piezoelectric-acoustic transducer according to the present invention includes:

- a hollow case provided with a sound-hole;
- a piezoelectric actuator that is arranged inside the case having one end secured to the case, and that bends in the direction of the thickness of the case when voltage is applied; and
- a diaphragm that is disposed at a distance from the piezoelectric actuator in the direction of thickness of the case and that has one part secured to one part of the piezoelectric actuator.

In a piezoelectric-acoustic transducer of the present invention constructed as described hereinabove, the application of voltage to the piezoelectric actuator causes the piezoelectric actuator to bend, thereby displacing the diaphragm with this bending and generating sound waves. Sound waves are therefore generated by the displacement rather than by the distortion of the diaphragm, and as a result, greater sound pressure is generated than in a case in which the diaphragm is distorted, thereby reducing distortion in the sound wave. Because the piezoelectric actuator and the diaphragm of this construction are secured in at just one part, the material used in one does not place constraints on the other, and materials that match the functions of each can therefore be freely selected.

In particular, the amount of bending of the piezoelectric actuator can be increased through the use of a bimorph element in which two piezoelectric ceramics are bonded together, one of which expands and the other of which contracts when voltage is applied. In addition, greater sound pressure can be obtained by making the length of the piezoelectric actuator substantially equal to the inner diameter of the case and by securing one part of the periphery of the diaphragm to the other end portion of the piezoelectric actuator, thereby increasing the displacement of the diaphragm with respect to bending of the piezoelectric actuator.

In addition, a piezoelectric-acoustic transducer of the present invention may also be constructed with two piezoelectric actuators. In this case, a linking member may be further provided that links one part of each piezoelectric actuator. The diaphragm may then be secured to the linking member at a distance from each piezoelectric actuator in the direction of thickness of the case.

In particular, the piezoelectric actuators may be bimorph elements that are arranged so as to bend in the same direction when voltage of mutually opposing direction is applied. Such a construction allows the hysteresis characteristic of each element to be canceled by the other when the piezoelectric actuators are driven together, and the diaphragm therefore can exhibit a linear displacement with respect to applied voltage.

By securing both end portions of each piezoelectric actuator to the case and securing the central portion of the diaphragm to the longitudinal centers of the two piezoelectric actuators, the diaphragm may be displaced in parallel with the bending of each piezoelectric actuator. Such a construction reduces irregularities in the phase of sound waves emitted from the sound-hole and further decreases distortion. Moreover, the interior of the case may be completely divided into two separate chambers and sound waves generated more efficiently with respect to displacement of the diaphragm by securing the outer periphery of the diaphragm to the case around its entire circumference using a deformable edge composed of a flexible material that can follow the displacement of the diaphragm.

The above and other objects, features, and advantages of the present invention will become apparent from the following description based on the accompanying drawings which illustrate examples of preferred embodiments of the present invention.

BRIEF DESCRIPTION OF THE DRAWINGS

FIG. 1(*a*) is a sectional view of a piezoelectric-acoustic transducer of the prior art, and FIG. 1(*b*) is a plan view showing the interior of the piezoelectric-acoustic transducer shown in FIG. 1(*a*).

DETAILED DESCRIPTION OF THE PREFERRED EMBODIMENTS

Embodiments of the present invention will next be explained with reference to the accompanying figures.

First Embodiment

Figure 2A:
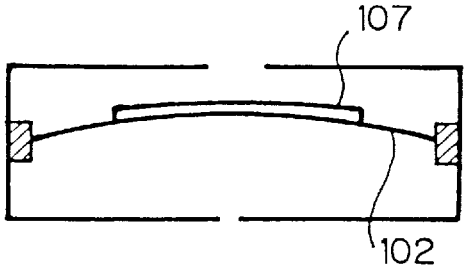
Fig. 2(a) Prior Art
FIGS. 2(*a*) and 2(*b*) are views for explaining the operation of the piezoelectric-acoustic transducer shown in FIGS. 1(*a*) and 1(*b*).
Figure 2B:
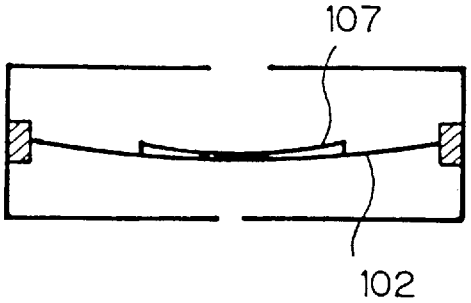
Fig. 2(b) Prior Art
Figure 3A:
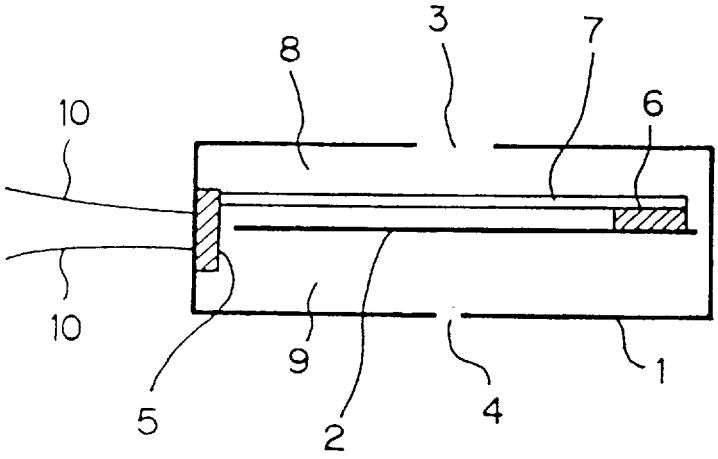
FIG. 3(*a*) is a sectional view showing a first embodiment of a piezoelectric-acoustic transducer according to the present invention, and FIG. 3(*b*) is a plan view showing the interior of the piezoelectric-acoustic transducer shown in FIG. 3(*a*).
Figure 3B:
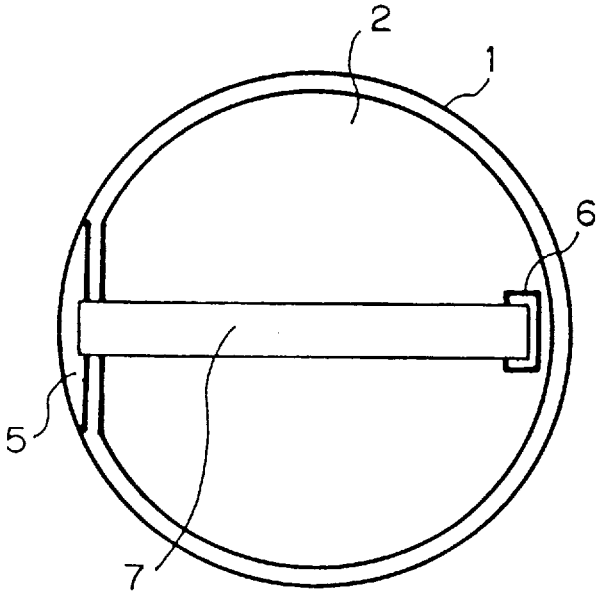

FIG. 3(*a*) is a sectional view and FIG. 3(*b*) is a plan view showing the interior of the piezoelectric-acoustic transducer according to the first embodiment of the present invention. Referring to FIGS. 3(*a*) and 3(*b*), bimorph element 7 is provided inside a hollow main case 1 as a piezoelectric actuator having a length substantially equal to the diameter of main case 1 and having one end secured to and supported by bimorph support 5. Diaphragm link member 6 is secured to the other end of bimorph element 7, and diaphragm 2 is secured to and supported at one portion by diaphragm link member 6. In this way, diaphragm 2 is arranged at substantially the center of main case 1 in the direction of thickness of main case 1, and the hollow interior of main case 1 is thus divided by diaphragm 2 into forward air chamber 8 and rear air chamber 9. Bimorph element 7 and diaphragm 2 are arranged at a distance from each other in the direction of thickness of main case 1. As diaphragm 2, various materials may be used including a light metal such as aluminum or duralumin, or a film macromolecular material or paper used in a dynamic electroacoustic transducer.

Forward air chamber 8 communicates with the exterior of main case 1 through sound hole 3 provided in main case 1, and sound waves are emitted through this sound hole 3. Rear air chamber 9 communicates with the exterior of main case 1 through leak hole 4 provided in main case 1, and the acoustic characteristic of the piezoelectric-acoustic transducer can be regulated by means of this leak hole 4.

Bimorph element 7 has two electrodes (not shown in the figures), and lead wires 10 for impressing voltage to bimorph element 7 from outside main case 1 are electrically connected to each of these electrodes by way of bimorph support 5. Bimorph element 7 will next be explained in greater detail with reference to FIG. 5 and FIGS. 6(*a*) and 6(*b*).

Figure 5:
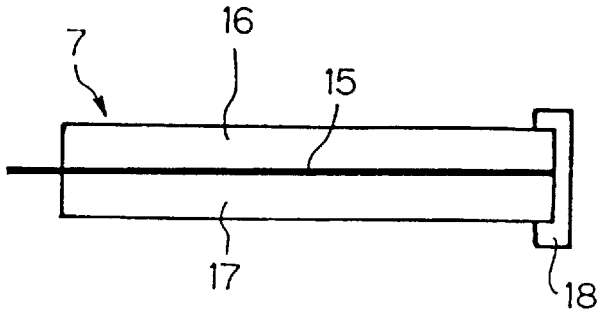
FIG. 5 shows the construction of the bimorph element of the piezoelectric-acoustic transducer shown in FIGS. 3(*a*) and 3(*b*).

As shown in FIG. 5, this bimorph element 7 is of a parallel construction in which a flexible plate 15 composed of a material such as phosphor bronze is sandwiched between first piezoelectric ceramic 16 and second piezoelectric ceramic 17, which are each provided as thin plates. First piezoelectric ceramic 16 and second piezoelectric ceramic 17 are arranged such that their directions of polarity are the same, and are electrically joined to each other by way of conductive foil 18. The two electrodes of bimorph element 7 are provided on first piezoelectric ceramic 16 and flexible plate 15, and voltage is applied between the two. In other words, the two piezoelectric ceramics 16 and 17 are electrically connected in parallel. As the material of first piezoelectric ceramic 16 and second piezoelectric ceramic 17, lead titanate zirconate ceramics or barium titanate ceramics may be used.

Figure 6:
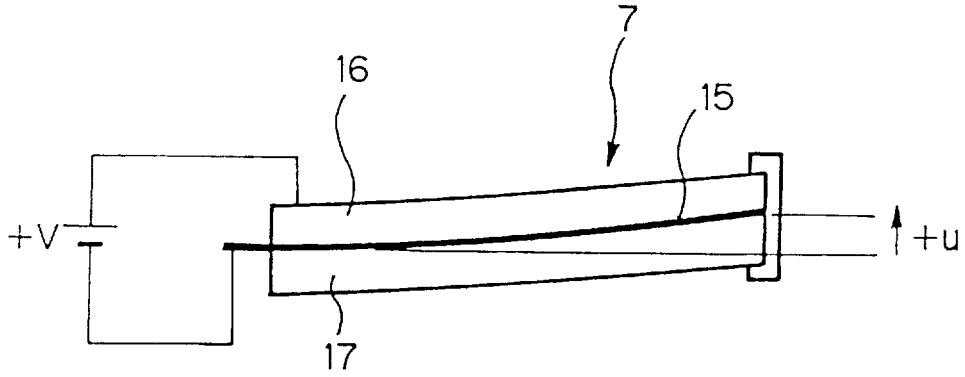
FIGS. 6(*a*) and 6(*b*) are view for explaining the operation of the bimorph element shown in FIG. 5.
Figure 6B:
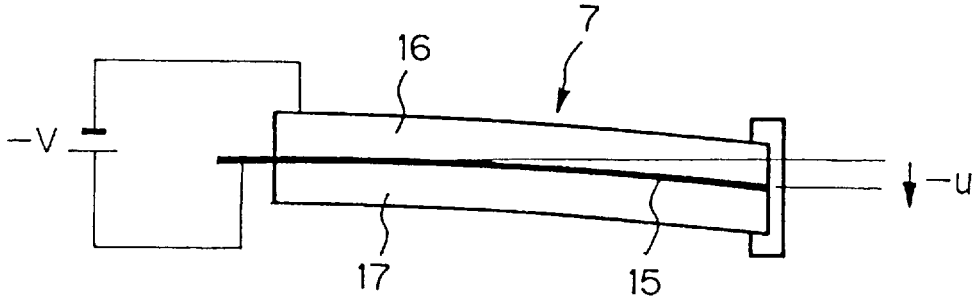

Based on the above-described construction, when voltage is impressed between first piezoelectric ceramic 16 and flexible plate 15, bimorph element 7 bends in an upward direction due to the contraction and expansion of piezoelectric ceramics 16 and 17, respectively, as shown in FIG. 6(*a*). Because one end of bimorph element 7 is secured to main case 1 by bimorph support 5 as shown in FIG. 3(*a*), the other end of bimorph element 7 is displaced in an upward direction by this distortion of bimorph element 7. On the other hand, when a voltage of the opposite direction is impressed between first piezoelectric ceramic 16 and flexible plate 15, the other end of bimorph element 7 is displaced in a downward direction as shown in FIG. 6(*b*). In other words, bimorph element 7 serves a double function as both a damper for holding diaphragm 2 and a driver of diaphragm 2.

Figure 7:
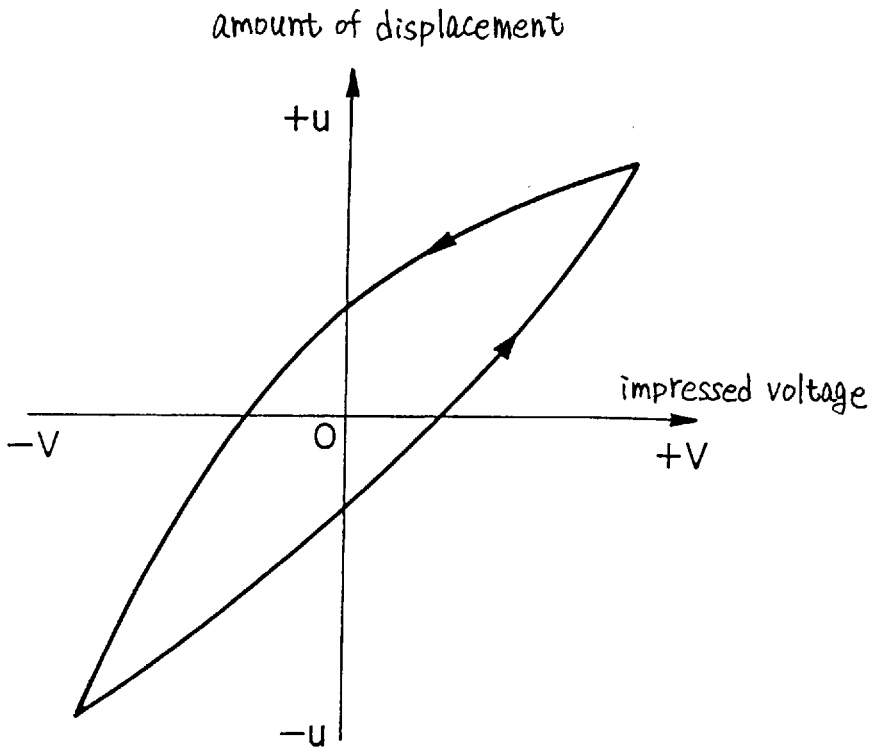
FIG. 7 is a graph showing the relation between applied voltage and amount of displacement of the other end of the bimorph element in the piezoelectric-acoustic transducer shown in FIGS. 3(*a*) and 3(*b*).

The amount of displacement of bimorph element 7 can be varied by means of the voltage applied to the bimorph element. FIG. 7 is a graph showing the relation between the voltage impressed to bimorph element 7 and the amount of displacement of the other end of the element. It can be seen from FIG. 7 that the displacement of bimorph element 7 in this embodiment exhibits a hysteresis characteristic.

Figure 4:
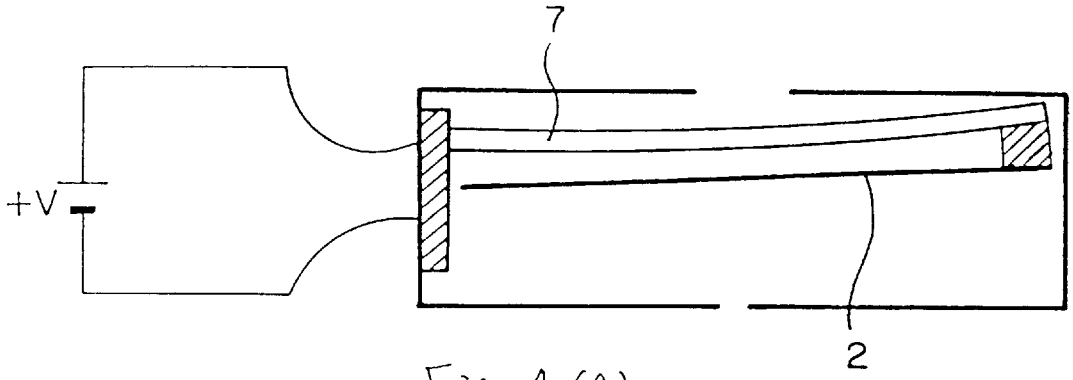
FIGS. 4(*a*) and 4(*b*) are views for explaining the operation of the piezoelectric-acoustic transducer shown in FIGS. 3(*a*) and 3(*b*).
Figure 4:
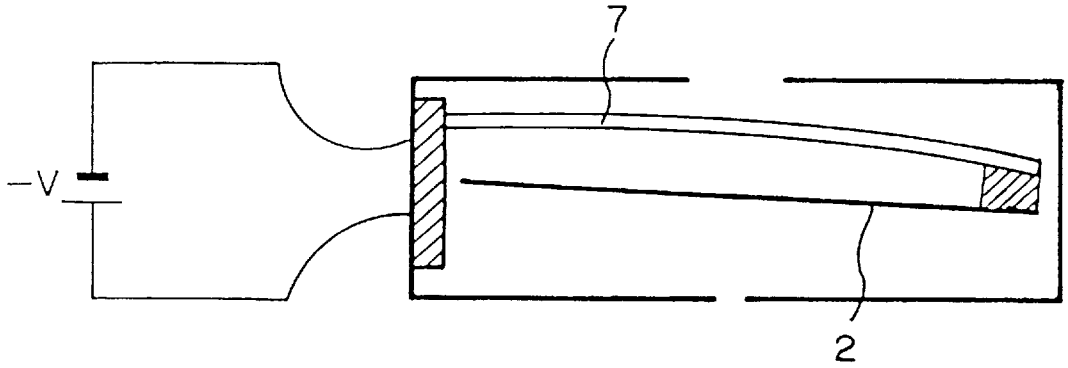

The operation of the piezoelectric-acoustic transducer shown in FIGS. 3(*a*) and 3(*b*) will next be explained with reference to FIG. 3(*a*) and FIGS. 4(*a*) and 4(*b*).

When voltage is not impressed to bimorph element 7, bimorph element 7 does not bend and diaphragm 2 remains at rest in the central portion of main case 1, as shown in FIG. 3(*a*). When voltage is impressed to bimorph element 7, bimorph element 7 bends in an upward direction and diaphragm 2 accordingly moves upward with the bimorph element as shown in FIG. 4(*a*). When voltage of the opposite direction is next impressed to bimorph element 7, bimorph element 7 bends downward as shown in FIG. 4(*b*) and diaphragm 2 accordingly moves downward with the element. Sounds waves are emitted from sound hole 3 through the repetition of the action shown in FIG. 4(*a*) and FIG. 4(*b*).

As described hereinabove, diaphragm 2 itself is not distorted but rather moved up and down using the bending of bimorph element 7, and as a result, the amount of movement of air in forward air chamber 8 is greater than for a case in which diaphragm 2 itself is distorted. In addition, bimorph element 7 and diaphragm 2 are arranged at a distance from each other in the direction of the thickness of main case 1, and bimorph element 7 therefore does not interfere with the displacement of diaphragm 2. Greater sound pressure can therefore be obtained than from a prior-art piezoelectric-acoustic transducer of the same size and level of impressed voltage.

In addition, the distortion of sound waves with respect to sound pressure can be reduced because sound waves are generated without bending diaphragm 2. Moreover, bimorph element 7 and diaphragm 2 are attached to each other by diaphragm link member 6 and are therefore constructed such that diaphragm 2 is not itself distorted, and as a result, the material, weight, and rigidity of both the bimorph element 7 and diaphragm 2 can be freely selected without placing constraints on the other component. Accordingly, the material, weight, and rigidity of both bimorph element 7 and diaphragm 2 can be selected according to the function of each component, thereby improving the degree of freedom in design for obtaining ideal acoustic characteristics.

Furthermore, one end of bimorph element 7 is supported by main case 1 while the other end of bimorph element 7 is fixed to a portion of diaphragm 2, thereby increasing the amount of displacement of diaphragm 2 by the square of the length of bimorph element 7. Accordingly, making the length of bimorph element 7 substantially equal to the diameter of main case 1 maximizes the amount of displacement of diaphragm 2, i.e., the sound pressure.

While this example of the embodiment employs a parallel bimorph element 7 as the piezoelectric actuator, the embodiment is not limited to this construction, and a series bimorph element in which two piezoelectric ceramics are arranged with opposite directions of polarity and electrically connected in a series may also be employed. Moreover, the piezoelectric actuator is not limited to a bimorph construction, and a unimorph construction having one piezoelectric ceramic may also be employed. In such a case, however, the amount of displacement of diaphragm 2 will be somewhat less than for case employing bimorph element 7.

Second Embodiment

A second embodiment of the piezoelectric-acoustic transducer of the present invention will next be explained with reference to FIGS. 8–10.

Figure 8:
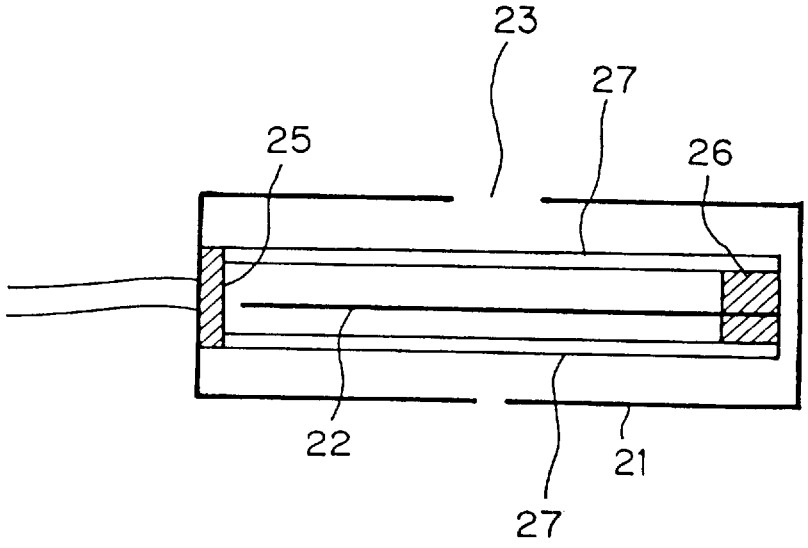
FIG. 8 is a sectional view showing a second embodiment of the piezoelectric-acoustic transducer of the present invention.

FIG. 8 is a sectional view of the second embodiment of the piezoelectric-acoustic transducer of the present invention. In FIG. 8, two bimorph elements 27 are arranged inside main case 21 parallel to and at a distance from each other in the direction of thickness of main case 21, and one end of each bimorph element is secured to bimorph support 25. The opposite end of both bimorph elements 27 are linked together by diaphragm link member 26. Diaphragm link member 26 is secured at its central portion to diaphragm 22, and when no voltage is impressed to the two bimorph elements 27, diaphragm 22 is positioned at the central portion of main case 21 in the direction of thickness of case 1.

Figure 9:
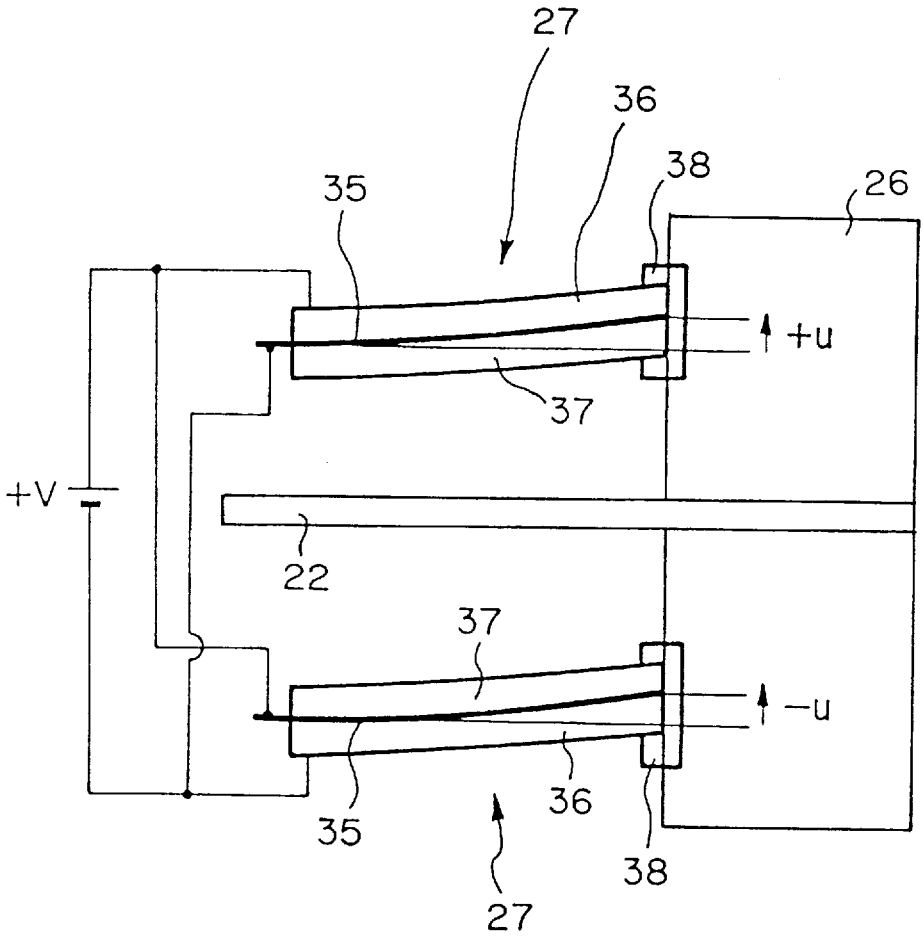
FIG. 9 is a view for explaining the construction and operation of the two bimorph elements of the piezoelectric-acoustic transducer shown in FIG. 8.

As shown in FIG. 9, each bimorph element 27 has the same construction as bimorph element 7 in the first embodiment. In other words, flexible plate 35 is sandwiched between first piezoelectric ceramic 36 and second piezoelectric ceramic 37, and first piezoelectric ceramic 36 and second piezoelectric ceramic 37 are electrically linked by conductive foil 38.

The chief feature of this embodiment is that the two bimorph elements 27 are arranged in mutually opposite directions, and moreover, voltage of opposing direction is applied to the two bimorph elements 27. As shown in FIG. 9, the two bimorph elements 27 are arranged with second piezoelectric ceramics 37 of each confronting each other, but the two bimorph elements 27 may also be arranged with first piezoelectric ceramics 36 confronting each other.

Other points of construction are equivalent to the first embodiment and explanation is therefore here omitted.

By arranging each bimorph element 27 as described hereinabove, each bimorph element 27 will bend in the same direction when voltage is applied to each bimorph element 27. FIG. 9 shows a case in which the other end of each of bimorph elements 27 is displaced upward. When voltage of the opposite direction is applied, the other end of each bimorph element 27 is displaced downward. Diaphragm 22 is displaced up and down together with the displacement of the two bimorph elements 27, and sound waves are thus emitted from sound hole 23 through repetition of these actions.

Figure 10:
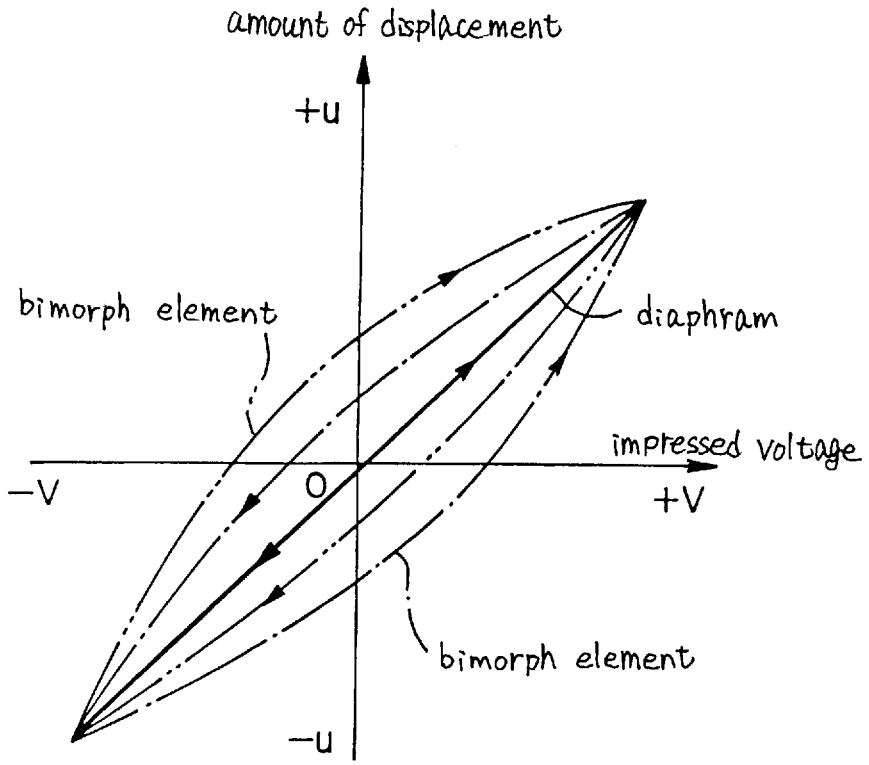
FIG. 10 is a graph showing the relation between applied voltage and the amount of displacement of the other end of each bimorph element and the relation between applied voltage and amount of displacement of the diaphragm in the piezoelectric-acoustic transducer shown in FIG. 8.

FIG. 10 is a graph showing the relation between voltage impressed to the bimorph elements 27 of this embodiment and the amount of displacement of each bimorph element 27 as well as the amount of displacement of diaphragm 22. In FIG. 10, the characteristics of each of bimorph elements 27 is shown by a single-dot-dash line and a double-dot dash line, while the characteristic of diaphragm 22 is indicated by a solid line. As shown in FIG. 10, each of the bimorph elements 27 exhibits a hysteresis characteristic with respect to impressed voltage, but these characteristics cancel each other to result in linear displacement of diaphragm 22 with respect to impressed voltage.

As described in the foregoing explanation, in addition to the effect of the first embodiment, this embodiment enables linear displacement of diaphragm 22 with respect to impressed voltage by disposing two bimorph elements 27 that bend in the same direction when mutually opposing voltage is applied, and as a result, this embodiment enables a reduction in distortion in generated sound waves.

Third Embodiment

The third embodiment of the piezoelectric-acoustic transducer of the present invention will next be explained with reference to FIGS. 11(*a*)–(*c*).

Figure 11A:
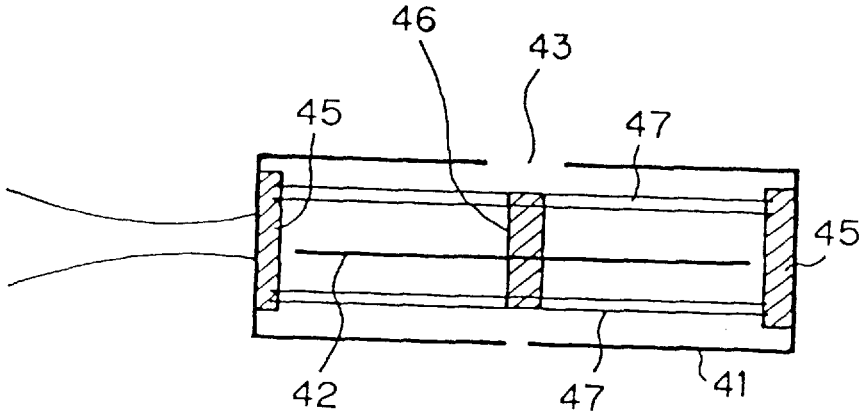
FIGS. 11(*a*) to 11(*c*) are sectional views for explaining the third embodiment of the piezoelectric-acoustic transducer of the present invention and its operation.
Figure 11B:
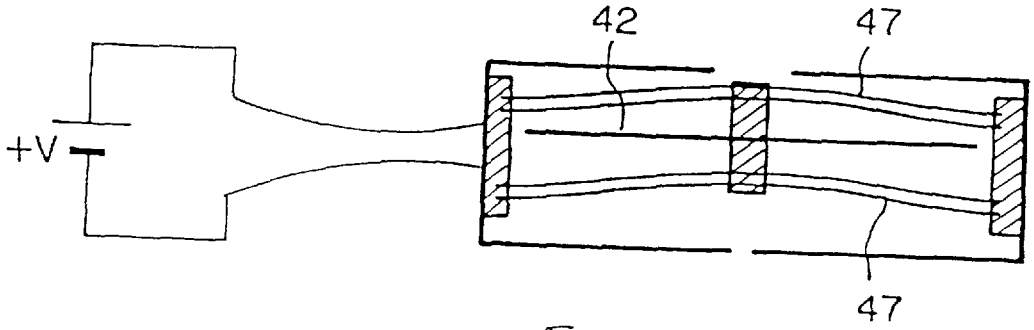
Figure 11C:
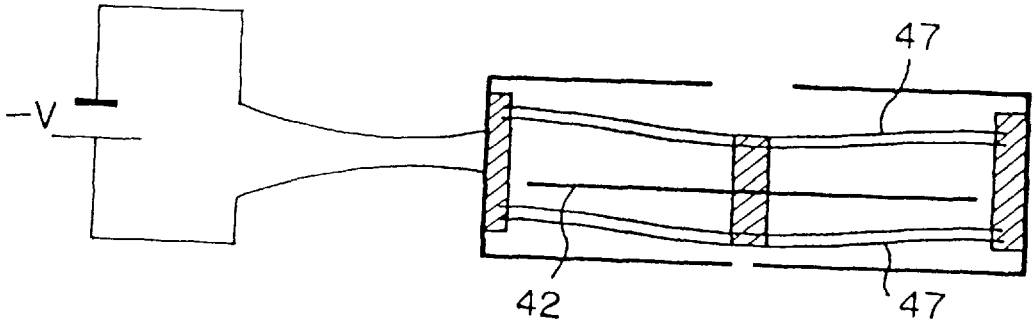

FIGS. 11(*a*)–(*c*) are sectional views illustrating the third embodiment of the piezoelectric-acoustic transducer of the present invention and its operation. In this embodiment as well, two bimorph elements 47 are arranged inside main case 41 both parallel to and at a distance from each other in the direction of thickness of main case 41, and diaphragm 42 is arranged between the two bimorph elements 47. In these respects, this embodiment is equivalent to the second embodiment, but the present embodiment differs from the second embodiment on the following two points: First, each bimorph element 47 is secured at both ends to main case 41 by bimorph supports 45; and second, diaphragm link member 46 is provided in the longitudinal center portion of each bimorph element 47 and supports the central portion of diaphragm 42. Other points of construction are equivalent to the second embodiment and explanation of these points is therefore here omitted.

Based on the above-described construction, when voltage is impressed to each bimorph element 47, each bimorph element 47 bends in the same direction as shown in FIG. 11(*a*), and diaphragm 42 is upwardly displaced. On the other hand, when voltage of the opposite direction is impressed to each bimorph element 47, diaphragm 42 is displaced downward as shown in FIG. 11(*c*). In addition to the effect provided by the first and second embodiments, this embodiment provides the effect of reducing irregularity in the phase of sound waves emitted from sound hole 43 and of further reducing distortion because diaphragm 42 is displaced up and down parallel to the bending of the two bimorph elements 47 within main case 41.

Fourth Embodiment

The fourth embodiment of the piezoelectric-acoustic transducer of the present invention will next be described with reference to FIG. 12.

Figure 12:
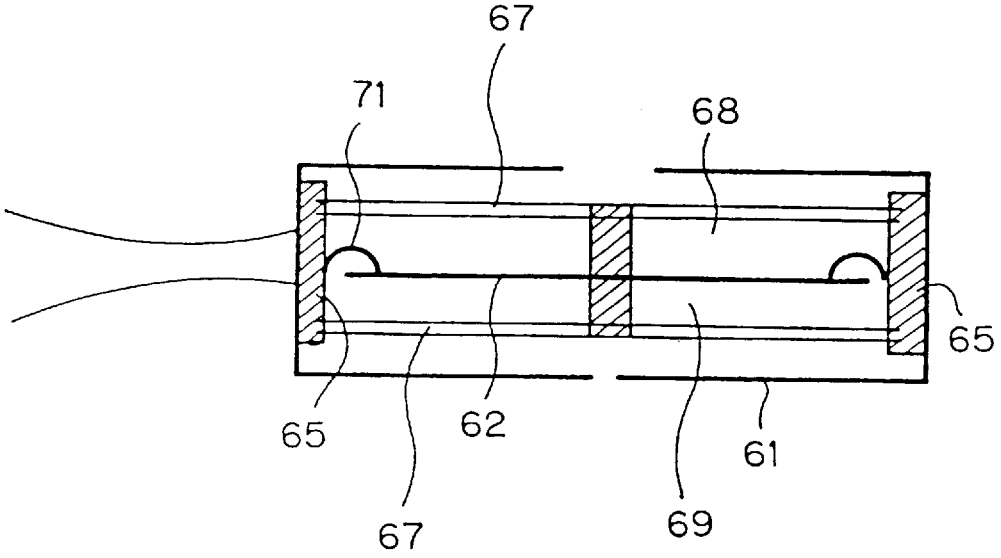
FIG. 12 is a sectional view showing a fourth embodiment of the piezoelectric-acoustic transducer of the present invention.

FIG. 12 is a sectional view showing the fourth embodiment of the piezoelectric-acoustic transducer of the present invention. This embodiment adds edge 71 to a construction that is otherwise equivalent to that of the third embodiment. Edge 71 is a ring shape composed of flexible material that is secured around its entire outer circumference to the inner wall of main case 61 and to each bimorph support 65 and secured around its entire inner perimeter to the outer circumference of diaphragm 62. The forward air chamber 68 and rear air chamber 69 within main case 61 are thus completely separated. In addition, edge 71 is semicircular in cross section and can flex in compliance with displacement of diaphragm 62, and edge 71 therefore does not interfere with the upward and downward displacement of diaphragm 62. Other points of construction are equivalent to the third embodiment and explanation is therefore here omitted.

As explained hereinabove, according to this embodiment, forward air chamber 68 and rear air chamber 69 are completely separated from each other by diaphragm 62 and edge 71 in the interior of main case 61, and consequently, sound waves are generated with excellent efficiency with respect to the displacement of diaphragm 62 that accompanies bending of each bimorph element 67. As a result, in addition to the effects of the third embodiment, this embodiment further adds the effect of preventing the generation of unwanted sound waves due to air currents generated from the gap between diaphragm 62 and main case 61.

As explained hereinabove, this invention allows an increase in generated sound pressure and a decrease in distortion of sound waves by securing one part of a piezoelectric actuator to just one portion of a diaphragm and using bending of the piezoelectric actuator to displace the diaphragm and generate sound pressure. Moreover, because the piezoelectric actuator and diaphragm are not constructed as a single unit, selection of the material employed in one component does not constrain the selection of material used in the other, thereby allowing greater freedom in the design of each component to allow use of material ideally suited to the function of each component.

In addition, greater sound pressure can be obtained by employing a piezoelectric actuator of a construction that employs the so-called bimorph structure or of a construction in which the length of the piezoelectric actuator is substantially equal to the inner diameter of the main case and the other end of the piezoelectric actuator is secured to one portion of the outer periphery of the diaphragm.

Moreover, when two piezoelectric actuators are employed, distortion in generated sound waves can be reduced by arranging each piezoelectric actuator such that both bend in the same direction when voltages of opposite directions are applied to the two actuators, thereby producing displacement of the diaphragm that is linear with respect to applied voltage. Distortion in sound waves can be further decreased by adopting a construction in which both ends of each piezoelectric actuator are secured to the case and the central portion of the diaphragm is linked to the longitudinal centers of each piezoelectric actuator. Finally, sound waves can be generated with greater efficiency with respect to displacement of the diaphragm by securing the diaphragm around its entire circumference to the case using a deformable edge composed of a flexible material that flexes in conformity with the displacement of the diaphragm.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. A piezoelectric-acoustic transducer comprising:

a hollow case provided with a sound-hole;

a piezoelectric actuator that is arranged inside said case having one end secured to said case, and that bends in the direction of the thickness of said case when voltage is applied, wherein the length of said piezoelectric actuator is substantially equal to the inner diameter of said case; and a diaphragm that is disposed at a distance from said piezoelectric actuator in the direction of thickness of said case and one portion of the periphery of said diaphragm is secured to one part of said piezoelectric actuator.

2. A piezoelectric-acoustic transducer according to claim 1 wherein said piezoelectric actuator is a bimorph element in which two piezoelectric ceramics are bonded together such that one of said piezoelectric ceramics expands and the other contracts when voltage is applied.

3. A piezoelectric-acoustic transducer comprising:

a hollow case provided with a sound-hole;

two piezoelectric actuators that bend in the direction of the thickness of said case when voltage is applied, each having at least one end secured to said case and each being arranged inside said case parallel to and at a distance from the other in the direction of the thickness of said case, wherein the length of each of said piezoelectric actuators is substantially equal to the inner diameter of said case;

a linking member that links one part of each of said piezoelectric actuators, wherein said linking member links the other ends of said piezoelectric actuators together; and a diaphragm that is arranged at a distance from each of said piezoelectric actuators in the direction of the thickness of said case and that is secured at one part with said linking member, wherein one part of the periphery of said diaphragm is secured to said linking member.

4. A piezoelectric-acoustic transducer according to claim 3 wherein each of said piezoelectric actuators is a bimorph element in which two piezoelectric ceramics are bonded together such that one of said piezoelectric ceramics contracts and the other expands when voltage is applied, said piezoelectric actuators being arranged so as to bend in the same direction when voltage of mutually opposing directions is applied.

5. A piezoelectric-acoustic transducer according to claim 3 wherein:

both ends of each of said piezoelectric actuators are secured to said case;

said linking member links together the longitudinal centers of said piezoelectric actuators; and the central portion of said diaphragm is secured to said linking member.

6. A piezoelectric-acoustic transducer according to claim 5 wherein said diaphragm is secured around its entire circumference to said case by an edge that is composed of a flexible material and that flexes in compliance with displacement of said diaphragm.

* * * * *